US008912960B1

(12) United States Patent
Andrenko et al.

(10) Patent No.: US 8,912,960 B1
(45) Date of Patent: Dec. 16, 2014

(54) ANTENNA APPARATUS

(71) Applicant: Fujitsu Limited, Kawasaki-shi, Kanagawa (JP)

(72) Inventors: Andrey S. Andrenko, Kawasaki (JP); Manabu Kai, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 14/218,613

(22) Filed: Mar. 18, 2014

(30) Foreign Application Priority Data

Nov. 7, 2013 (JP) ..... 2013-231414

(51) Int. Cl.
*H01Q 1/38* (2006.01)
*H01Q 21/08* (2006.01)
*H01Q 21/29* (2006.01)

(52) U.S. Cl.
CPC ..... *H01Q 21/293* (2013.01)
USPC ..... 343/700 MS; 343/824; 343/895

(58) Field of Classification Search
CPC ..... H01Q 1/38; H01Q 21/08; H01Q 5/0058; H01Q 9/045; H01Q 19/005; H01Q 21/293; H01L 2223/6677; H01L 2224/48091
See application file for complete search history.

(56) References Cited

U.S. PATENT DOCUMENTS 5,076,655 A * 12/1991 Bridges ..... 385/3
6,424,298 B1 * 7/2002 Nishikawa et al. .... 343/700 MS
6,670,922 B1 * 12/2003 Huang et al. ..... 343/700 MS
7,750,813 B2 7/2010 Deavours et al.
8,624,784 B2 * 1/2014 Mizutani et al. ..... 343/700 MS
8,736,507 B2 * 5/2014 Ohno ..... 343/818
2010/0026582 A1 * 2/2010 Choi et al. ..... 343/700 MS
2010/0171666 A1 * 7/2010 Mizutani et al. ..... 343/700 MS

OTHER PUBLICATIONS

Medeiros, Carla R. et al., "RFID Smart Shelf With Confined Detection Volume at UHF," IEEE Antennas and Wireless Propogation Letters, vol. 7, 2008, pp. 773-776.

Michel., A. et al., "Design and Performance Analysis of a Planar Antenna for Near-Field UHF-RFID Desktop Readers," Proceedings of APMC 2012, Kaohsiung, Taiwan, Dec. 4-7, 2012, pp. 1019-1021.

* cited by examiner

*Primary Examiner* — Trinh Dinh
(74) *Attorney, Agent, or Firm* — Arent Fox LLP

(57) ABSTRACT

An antenna apparatus includes a first dielectric layer, a ground plane, a conductive line, a second dielectric layer, and a first conductive element and a second conductive element configured to be disposed on the second dielectric layer so that the first and the second conductive elements intersect the conductive line at first and second positions corresponding to first and second nodes of a standing wave of current flowing through the conductive line, respectively, wherein the first and the second conductive elements are bent or rounded toward a feeding point with respect to the first and the second positions in plan view, respectively, and wherein a first bent degree, a first rounded degree or a first length of the first conductive element is different from a second bent degree, a second rounded degree or a second length of the second conductive element.

12 Claims, 16 Drawing Sheets

ANTENNA APPARATUS

CROSS-REFERENCE TO RELATED APPLICATIONS

This patent application is based upon and claims the benefit of priority of the prior Japanese Patent Application No. 2103-231414 filed on Nov. 7, 2013, the entire contents of which are incorporated herein by reference.

FIELD

The embodiments discussed herein are related to an antenna apparatus.

BACKGROUND

Recently, Radio Frequency IDentification (RFID) systems have been widely used. Typically, some RFID systems utilize electromagnetic waves of a UHF band (900 MHz band) or a microwave band (2.45 GHz) as a communication medium, and some RFID systems utilize a magnetic field generated by mutual induction. Among them, the REID system utilizing an electromagnetic wave in the UHF band is attracting attention since the RFID system can provide relatively long communication distance.

A microstrip antenna is proposed as an antenna which is used by a reader-writer that communicates with an RFID tag utilizing an electromagnetic wave in the UHF band. The microstrip antenna includes a microstripline as the antenna (see Patent Reference 1 and Non-Patent References 1 and 2, for example).

There is a system which includes an antenna provided on a surface of a shelf. Merchandise to which an RFID tag is attached is arranged on the shelf. The system identifies that the merchandise is taken away from the shelf when the system becomes unable to detect the RFID tag. In such a system, it is preferable to use an antenna apparatus which can read the RFID tags attached to the merchandise provided in an area close to the surface of the antenna and can read the RFID tags over the entire surface of the shelf.

However, a communication distance of the conventional antenna is not sufficient and it is difficult to generate a uniform electric field over the entire surface of the antenna, particularly when size of the antenna becomes larger. Accordingly, it is difficult for the conventional antenna to provide uniform and sufficient communication distance.

Therefore, it is difficult to read all of the RFID tags uniformly in a case where a plurality of merchandise to which the RFID tags are attached is arranged on the shelf, in a case where the conventional antenna is used in the system as described above.

PRIOR ART REFERENCES

Patient References

[Patent Reference 1] U.S. Pat. No. 7,150,813

Non-Patent References

[Non-Patent Reference 1] Carla R. Medeiros, Jorge P. Costa, Member, IEEE, and Carlos A. Fernandes, Senior Member, IEEE "RFID Smart Shelf With Confined Detection Volume at UHE", IEEE ANTENNAS AND WIPELESS PROPAGATION LETTERS, vol. 7, pp. 773-776, 2008

[Non-Patent Reference 2] A. Michel, A. Buffi, R. Caso, P. Nepa, G. Isola and H. T. Chou "Design and Performance Analysis of a Planar Antenna for Near-Field UHF-RFID Desktop Readers", Proceeding of APMC 2012, Kaohsiong, Taiwan, Dec. 4-7, 2012

SUMMARY

According to an aspect of an embodiment, there is provided an antenna apparatus including a first dielectric layer having a rectangular shape in plan view, a ground plane configured to be disposed on a first surface of the first dielectric layer, a conductive line configured to have a first end and a second end and to be disposed on a second surface of the first dielectric layer, the first end being a feeding point, the second end being an open end or a short end connected to the ground plane, a second dielectric layer configured to have a shape corresponding to the first dielectric layer and to be disposed on the second surface of the first dielectric layer in a state where the conductive line is sandwiched between the first dielectric layer and the second dielectric layer, the second dielectric layer having a first surface facing toward the first dielectric layer and a second surface opposite to the first surface; and a first conductive element configured to be disposed on the second surface of the second dielectric layer so that the first conductive element intersects the conductive line at a first position corresponding to a first node of a standing wave of current flowing through the conductive line in plan view, respectively, a second conductive element configured to be disposed on the second surface of the second dielectric layer so that the second conductive element intersects the conductive line at a second position corresponding to a second node of the standing wave in plan view, respectively, wherein the first conductive element and the second conductive element are bent or rounded toward the feeding point with respect to the first position and the second position corresponding to the first node and the second node in plan view, respectively, and wherein a first bent degree, a first rounded degree or a first length of the first conductive element is different from a second bent degree, a second rounded degree or a second length of the second conductive element.

The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

BRIEF DESCRIPTION OF THE DRAWINGS

FIG. 4 is an exploded oblique perspective diagram illustrating the antenna apparatus 100.

DESCRIPTION OF EMBODIMENTS

A description is given, with reference to the accompanying drawings, of embodiments of an antenna apparatus.

First Embodiment

Figure 1:
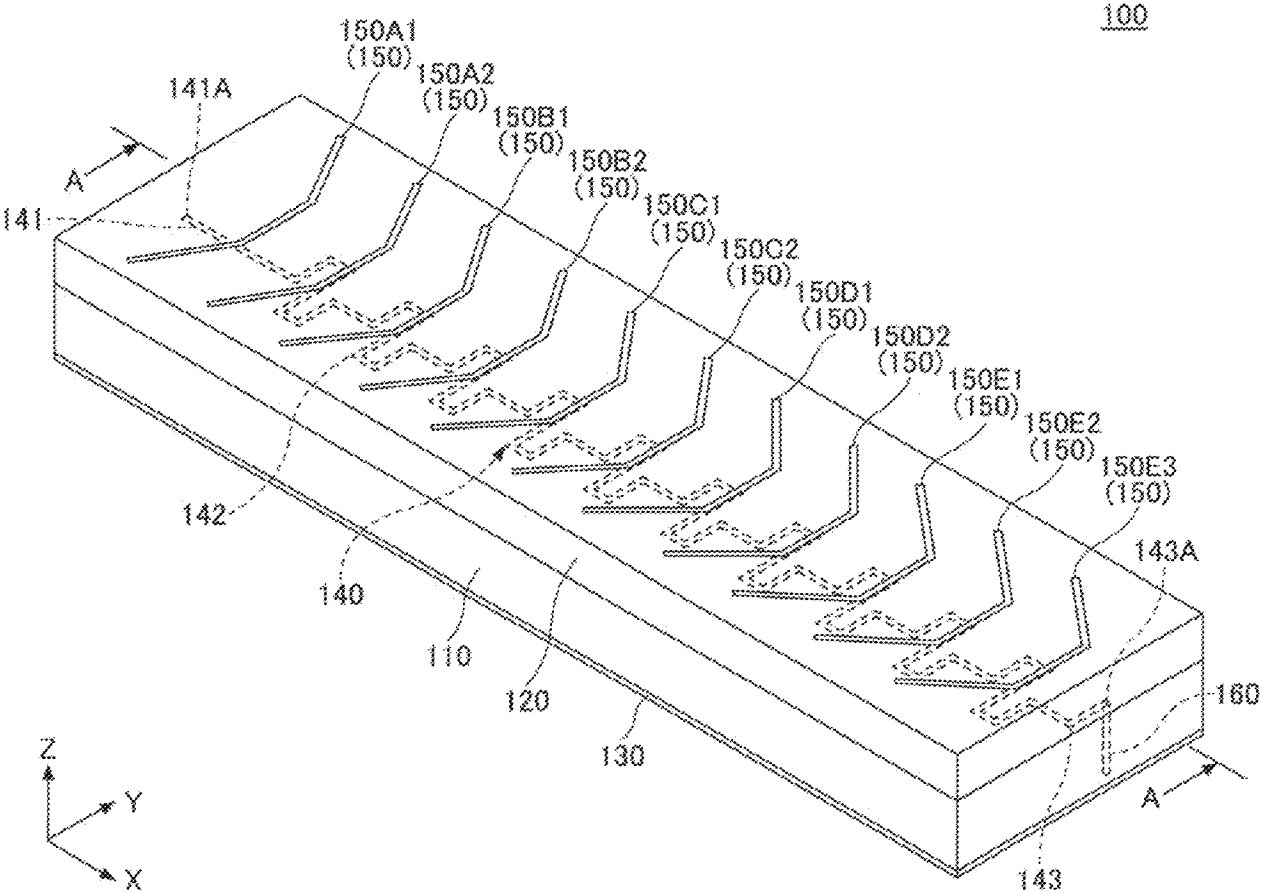
FIG. 1 is an oblique perspective diagram illustrating an antenna apparatus 100 of the first embodiment.
Figure 2:
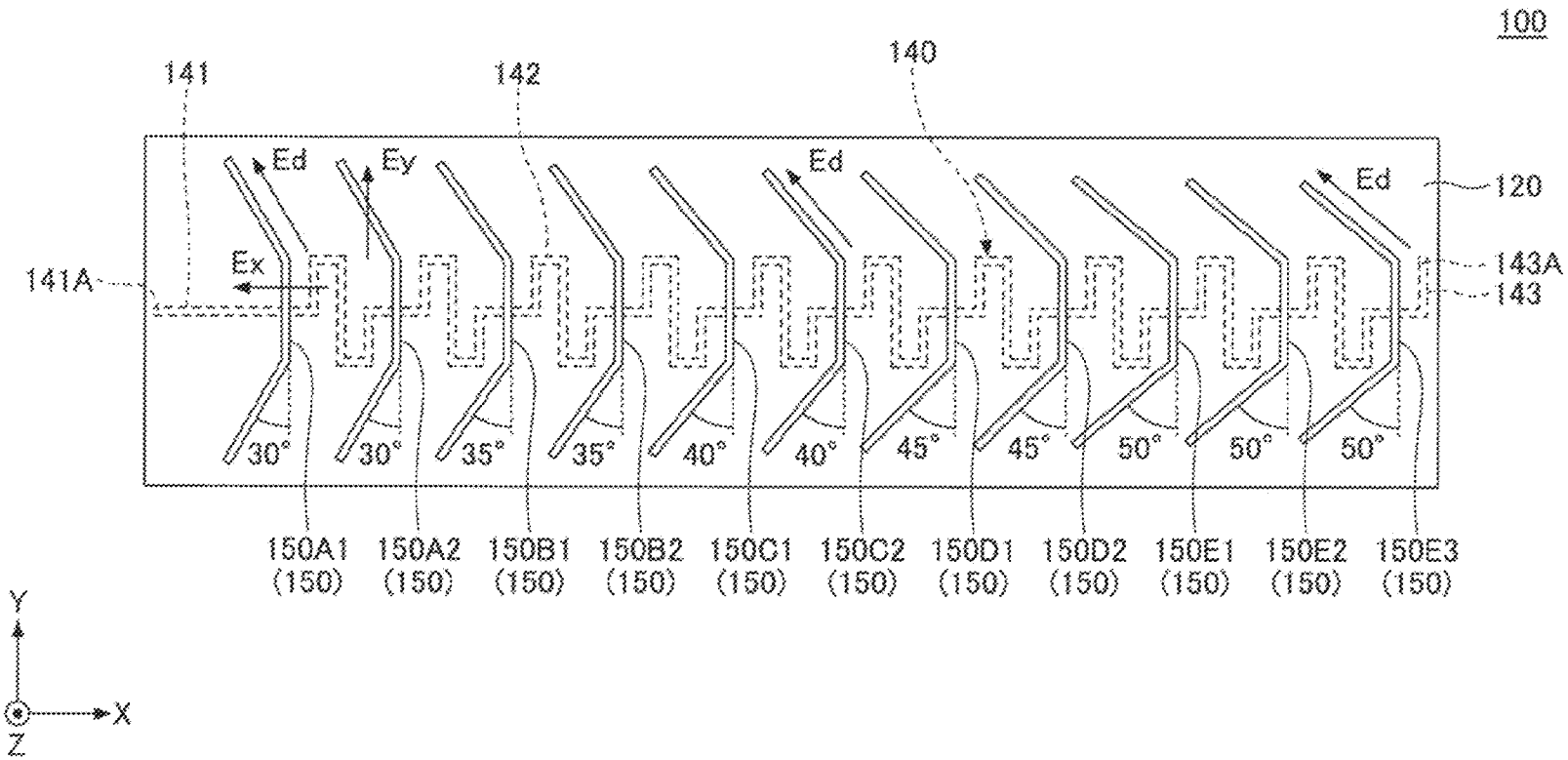
FIG. 2 is a diagram illustrating the antenna apparatus 100 of the first embodiment in plan view.
Figure 3:
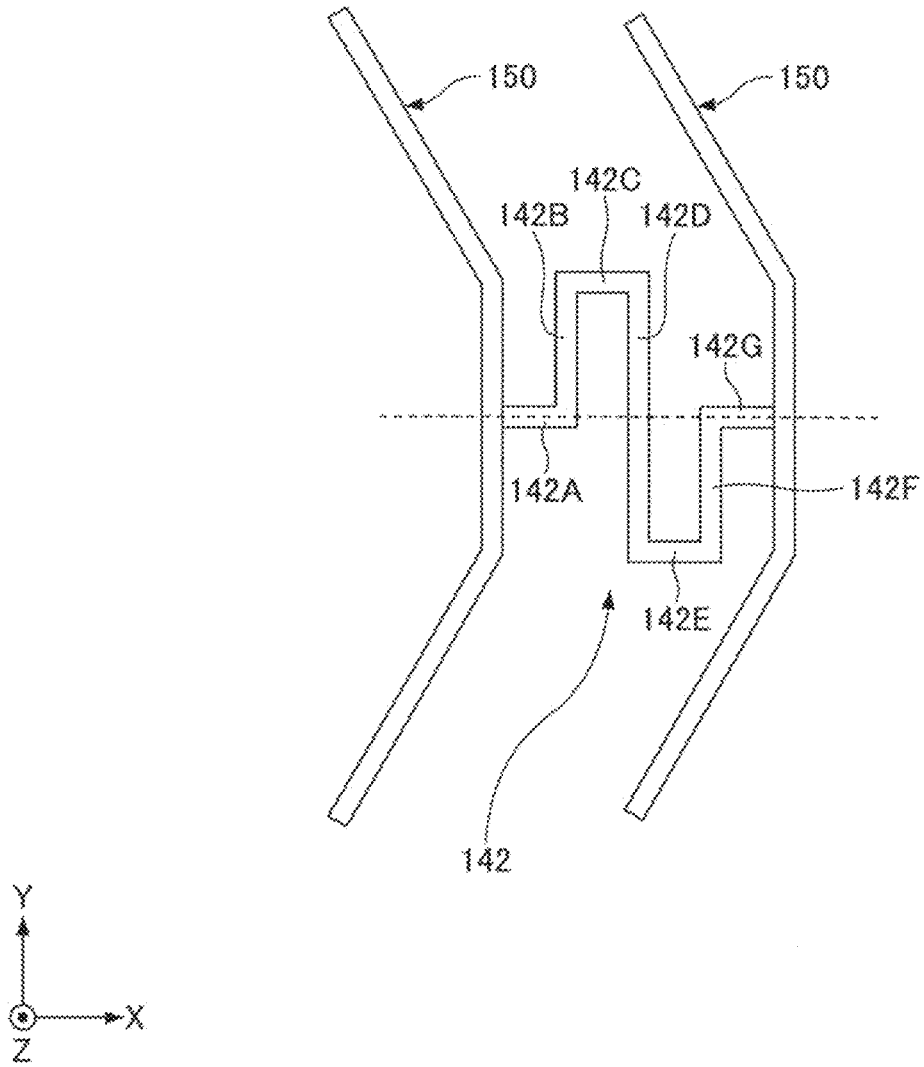
FIG. 3 is an enlarged diagram illustrating a part of the antenna apparatus 100.
Figure 4:
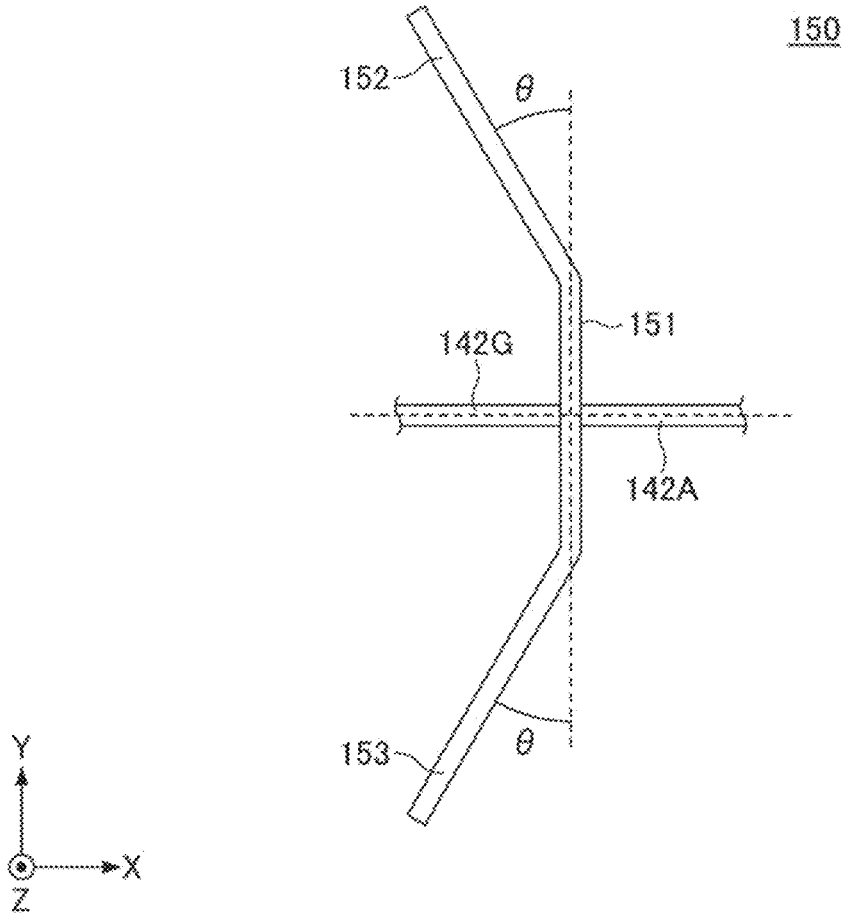
FIG. 4 is an enlarged diagram illustrating another part of the antenna apparatus 100.
Figure 5:
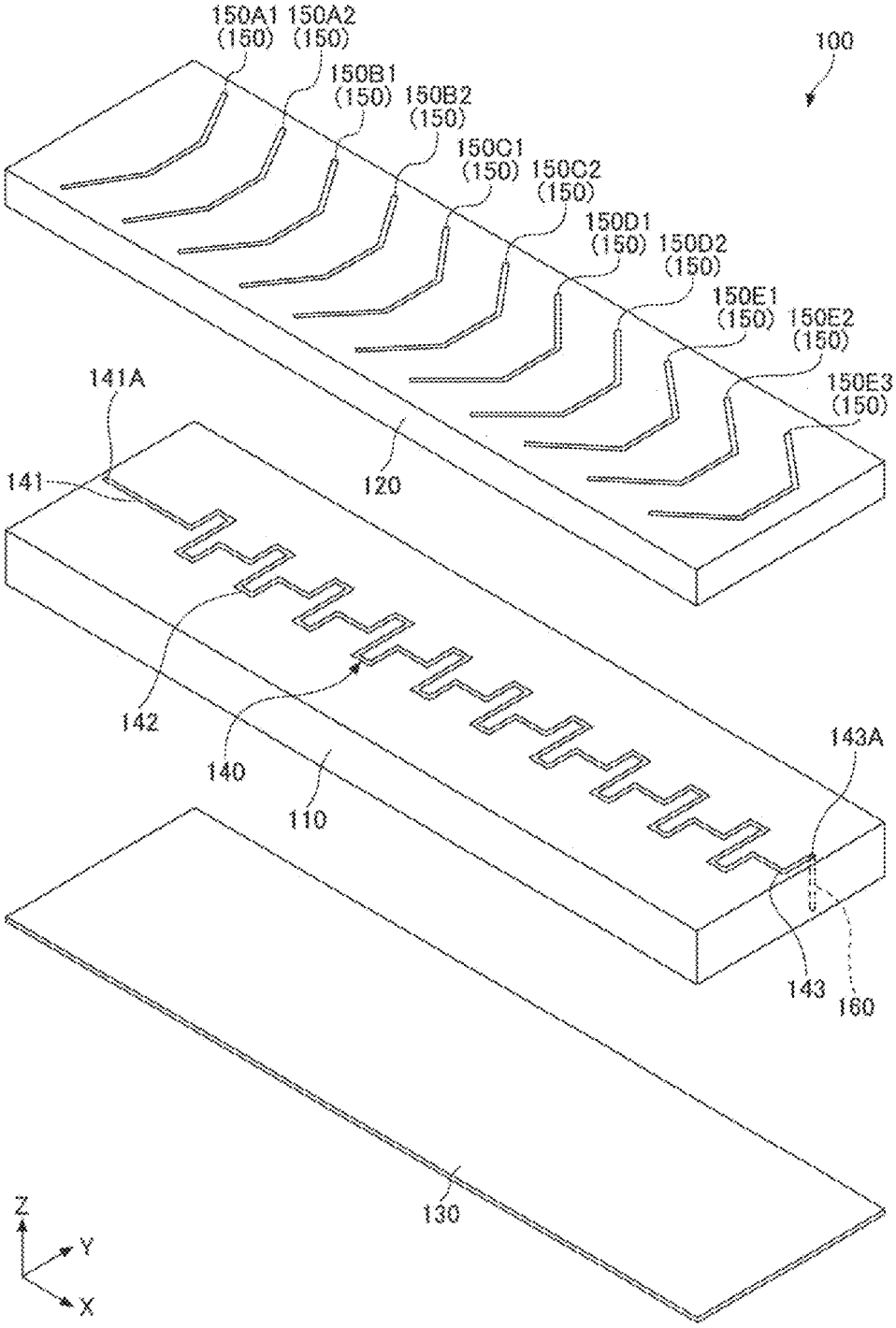
Figure 6:
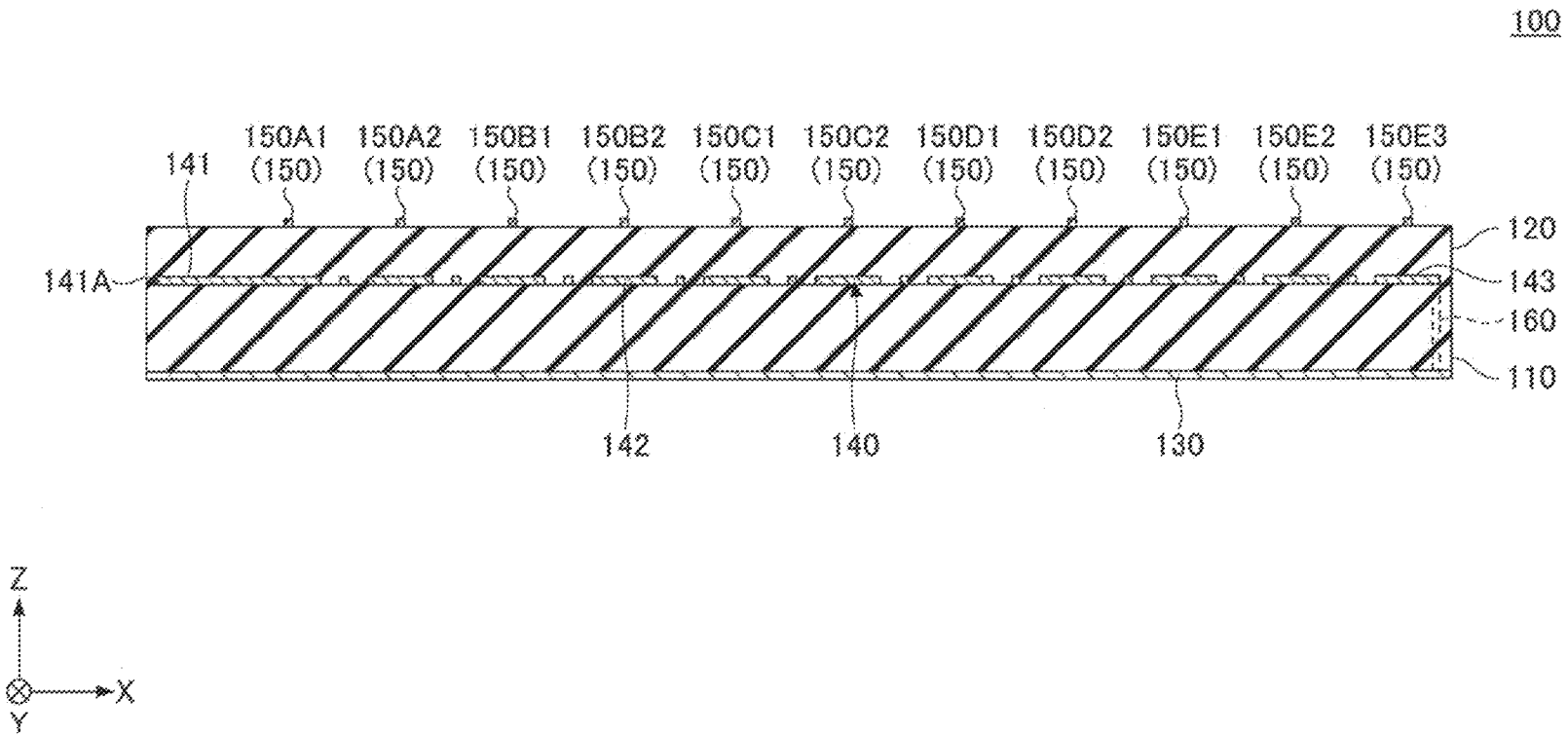
FIG. 6 is a diagram illustrating an A-A cross section of the antenna apparatus 100 as illustrated in FIG. 1.

FIG. 1 is an oblique perspective diagram illustrating an antenna apparatus 100 of the first embodiment. FIG. 2 is a diagram illustrating the antenna apparatus 100 of the first embodiment in plan view. FIG. 3 is an enlarged diagram illustrating a part of the antenna apparatus 100. FIG. 4 is an enlarged diagram illustrating another part of the antenna apparatus 100. FIG. 5 is an exploded oblique perspective diagram illustrating the antenna apparatus 100. FIG. 6 is a diagram illustrating an A-A cross section of the antenna apparatus 100 as illustrated in FIG. 1.

Hereinafter, the antenna apparatus 100 will be described by using a XYZ coordinate system as an orthogonal coordinate system. Hereinafter, for the purpose of illustration, a surface which is located in the negative Z axis direction will be referred to as a bottom surface, and a surface which is located in the positive Z axis direction will be referred to as a top surface. However, the top surface and the bottom surface are just expedient names and do not mean a universalistic relationship of upper and lower.

The antenna apparatus 100 includes dielectric layers 110 and 120, a ground plane 130, a meander conductive line 140 and conductive strips 150. The antenna apparatus 100 includes eleven conductive strips 150. In a case where the eleven conductive strips 150 are distinguished from each other, the eleven conductive strips 150 are referred to as conductive strips 150A1, 150A2, 150B1, 150B2, 150C1, 150C2, 150D1, 150D2, 150E1, 150E2 and 150E3. In a case where the conductive strips 150A1 to 150E3 are not distinguished from each other, the conductive strips 150A1 to 150E3 will be described as the conductive strip 150.

The antenna apparatus 100 of the first embodiment is used for communicating electromagnetic waves in the UHF band, and a resonant frequency (central frequency) of the antenna apparatus 100 may be range from about 860 MHz to about 960 MHz, for example. In this embodiment, the antenna apparatus 100 having the resonant frequency (central frequency) of 919 MHz will be described, for example.

Since the antenna apparatus 100 communicates at the resonant frequency (central frequency), among configuration element included in the antenna apparatus 100, lengths of the meander conductive line 140 and the conductive strips 150 are set to lengths that correspond to wavelength at the resonant frequency.

Since the wavelength at the resonant frequency may be shortened by a shortening effect in a dielectric material, the lengths of the meander conductive line 140 the conductive strips 150 may be determined in the light of relative permittivity of the dielectric layers 110 and 120.

For example, the real wavelength is about 326 mm at 919 MHz, whereas the wavelength $\lambda$ in light of lateral permittivity of the dielectric layers 110 and 120 is about 180 mm. The wavelength $\lambda$ in light of relative permittivity is used for designing dimensions of the meander conductive line 140 and the conductive strips 150.

Hereinafter, designing the lengths of the meander conductive line 140 and the conductive strips 150 or the like based on the wavelength in light of the relative permittivity of the dielectric layers 110 and 120 or the like will be referred to as determining the lengths corresponding to the wavelength at the resonant frequency. A length of the wavelength obtained in a dielectric material will be referred to as a length corresponding to the wavelength at the resonant frequency.

The dielectric layers 110 and 120 are sheeted substrate materials that have rectangular shapes in plan view. A substrate of the antenna apparatus 100 is constituted by adhering the dielectric layers 110 and 120 to each other while the meander conductive line 140 is placed therebetween. The dielectric layer 110 is one example of a first dielectric layer, and the dielectric layer 120 is one example of a second dielectric layer.

Lengths of the dielectric layers 110 and 120 in X axis direction are 730 mm, and lengths widths; of the dielectric layers 110 and 120 in Y axis direction are 200 mm, for example. Thickness of the dielectric layer 110 is 1.6 mm, and thickness of the dielectric layer 120 is 1.0 mm.

For the purpose of illustration, thicknesses of the dielectric layers 110 and 120 are illustrated thicker than real thickness.

In the first embodiment, the dielectric layers 110 and 120 are Flame Retardant type 4 (FR4) standardized substrate materials, for example. For example, glass-reinforced epoxy laminate sheets made of glass cloth dipped into epoxy resin may be used as the dielectric layers 110 and 120. For example, relative permittivity $\in r$ of each of the dielectric layers 110 and 120 is 4.4, and dielectric tangent tan $\delta$ is 0.02.

The ground plane 130 is disposed on the bottom surface of the dielectric layer 110, and the meander conductive line 140 is disposed on the top surface of the dielectric layer 110. The conductive strips 150 are disposed on the top surface of the dielectric layer 120.

The ground plane 130 is made of copper foil, for example, and constitutes a microstripline with the meander conductive line 140.

The meander conductive line 140 is disposed on the top surface of the dielectric layer 110. The meander conductive line 140 is one example of a conductive line. The meander conductive line 140 constitutes the microstripline with the ground plane 130. The microstripline functions as a microstrip antenna. Characteristic impedance of the microstrip antenna may be 50Ω or 75Ω, for example.

Since the meander conductive line 140 is disposed on the top surface of the dielectric layer 110 and is located under the dielectric layer 120, the meander conductive line 140 is insulated from the conductive strips 150 that are disposed on the top surface of the dielectric layer 120.

The meander conductive line 140 is made by patterning a copper foil, for example. The meander conductive line 140 is a type of a conductive part which extends along X axis while snaking in Y axis direction in a meander fashion. Width of the meander conductive line 140 is 3 mm, for example.

The meander conductive line 140 includes a straight portion 141, meander portions 142 and an L-shaped portion 143. The straight portion 141 extends in X axis direction. An end portion of the straight portion 141 located in negative X direction side constitutes a first end of the meander conductive line 140, and constitutes a feeding point 141A.

The straight portion 141 is located on the central axis, parallel to X axis, of the dielectric layers 110 and 120. A cable core of a coaxial cable connected to a reader-writer may be connected to the feeding point 141A, for example.

Ten meander portions 142 are located in positive X direction side of the straight portion 141 and are connected in series with each other. The ten meander portions 142 have the same pattern which is illustrated in FIG. 3. Single units of the meander portion 142 have a shape as illustrated in FIG. 3. The meander portion 142 includes straight portions 142A, 142B, 142C, 142D, 142E, 142F and 142G. In FIG. 3, for the sake of indicating a positional relationship of the meander portion 142 and the conductive strips 150 in an easy-to-understand manner, the meander portion 142 and the conductive strips 150 are illustrated transparently.

As illustrated in FIG. 3, the meander portion 142 is located between a pair of the conductive strips 150. A line length of the meander portion 142 is set to a length corresponding to the single wavelength (λ) at the resonant frequency. The line length of the meander portion 142 is obtained between a crossover point of the straight portion 142A and one conductive strip 150 and a crossover point of the straight portion 142G and another conductive strip 150.

In FIG. 3, a dashed line extending in X axis direction is the central axis of the dielectric layers 110 and 120 in X axis direction. The straight portions 142A and 142G are located on the central axis. The meander portion 142 has a shape which is in symmetry with respect to a crossover point of the straight portion 142D and the central axis.

The straight portion 142A extends on the central axis from negative X direction side to positive X direction side. The straight portion 142B is connected to a positive-X-direction-side-end-portion of the straight portion 142A and extends in positive Y direction from the end-portion.

The straight portion 142C is connected to a positive-Y-direction-side-end-portion of the straight portion 142B and extends in positive X direction from the end-portion. The straight portion 1420 is connected to a positive-X-direction-side-end-portion of the straight portion 142C and extends in negative Y direction from the end-portion. The straight portion 142E is connected to a negative-Y-direction-side-end-portion of the straight portion 142D and extends in positive X direction from the end-portion.

The straight portion 142F is connected to a positive-X-direction-side-end-portion of the straight portion 142E and extends in positive Y direction from the end-portion. The straight portion 142G is connected to a positive-Y-direction-side-end-portion of the straight portion 142F and extends in positive X direction from the end-portion.

The meander portion 142 including the straight portions 142A, 142B, 142C, 142D, 142E, 142F, and 142G, as described above, extends along X axis while snaking in Y axis direction in the meander fashion. In the meander conductive line 140, the ten meander portions 142 are connected in series between the straight portion 141 and the L-shaped portion 143 from negative X direction side to positive X direction side.

The L-shaped portion 143 (see FIG. 2) is connected to the positive-X-direction-side-end-portion of the ten meander portions 142 connected in series with each other. The L-shaped portion 143 extends from the positive-X-direct ion-side-end-portion of the tenth meander portion 142, bends at right angle and extends in positive X direction, and bends n right angle and extends in positive Y direction to an end portion. The end portion of the L-shaped portion 143 constitutes a second end of the meander conductive line 140 and a positive-X-direction-side-end-portion of the meander conductive line 140. The end portion constitutes a ground point (a short end) 143A.

As illustrated in FIG. 5, the ground point 143A is connected to the ground plane 130 via a through hole 160 which penetrates the dielectric layer 110 in a direction of thickness (in Z axis direction). The through hole 160 includes a conductive wall which connects the ground point 143A and the ground plane 130 electrically. Accordingly, the second end, i.e. the ground point 143A, of the meander conductive line 140 is shorted to ground.

The length of the L-shaped portion 143 is set to a length corresponding to quarter wavelength (λ/4) at the resonant frequency. In a case where the L-shaped portion 143 is an open end, the length of the L-shaped portion 143 may be set to a length corresponding to half wavelength (λ/2) at the resonant frequency.

As described above, the length of the L-shaped portion 143 having the ground point 143A is set to the length corresponding to the quarter wavelength (λ/4) at the resonant frequency. If the meander conductive line 140 is fed from the feeding point 141A, a standing wave of current is formed on the meander conductive line 140. Nodes of the standing wave occur at eleven locations that are λ/4, 3λ/4, 5λ/4, 7λ/4, 9λ/4, 11λ/4, 13λ/4, 15λ/4, 17λ/4, 19λ/4 and 21λ/4 away from the ground point 143A, respectively. These lengths are obtained by multiplying integer numbers by the half wavelength at the resonant frequency and by subtracting a quarter wavelength at the resonant frequency from the multiplied result of the integer numbers and the half wavelength, respectively.

In other words, the eleven nodes occur at a boundary between the straight portion 141 and the meander portion 142, nine boundaries between the ten meander portions 142, and a boundary between the meander portion 142 and the L-shaped portion 143, respectively.

Each of the nodes of the standing wave of current is a point where current value becomes zero and electric field becomes the maximum value. In the antenna apparatus 100 of the first embodiment, the conductive strips 150 are disposed on the meander conductive line 140 via the dielectric layer 120 and intersect the meander conductive line 140 at the locations of the nodes of the standing wave of the current, in order to electromagnetically couple the meander conductive line 140 and the conductive strips 150 and to maximize the electric field generated by the conductive strips 150.

The microstrip antenna including the meander conductive line 140 makes it possible to perform communications in the near field by utilizing electric field which leaks from the top surface of the microstrip antenna. Herein, the electric field which leaks from the top surface of the microstrip antenna is referred to as leak electric field.

The conductive strips 150 are constituted of eleven conductive patterns that are disposed on the top surface of the dielectric layer 120. Each of the conductive strips 150 is one example of a first conductive element or a second conductive element. A bent degree, a rounded degree or a length of the first conductive element is different from that of the second conductive element. Since the conductive strips 150 are disposed on the top surface of the dielectric layer 120, the conductive strips 50 are insulated from the meander conductive line 140. The conductive strips 150 are made by patterning copper foil, for example. A line width of each of the conductive strips 150 is 4 mm, for example.

As illustrated in FIG. 4, the conductive strip 150 includes straight portions 151, 152 and 153. In FIG. 4, for the sake of indicating a positional relationship of the conductive strip 150 and the straight portions 142A and 142G of the meander portion 142 in an easy-to-understand manner, the conductive strips 150 and the straight portions 142A and 142G are illustrated transparently.

The straight portion 151 extends in parallel with Y axis. Accordingly, the straight portion 151 intersects the straight portions 142A and 142G at right angle. The straight portion 152 is formed in positive Y direction side of the straight portion 151 in a continuous fashion, and the straight portion 153 is formed in negative Y direction side of the straight portion 151 in a continuous fashion.

The straight portions 152 and 153 are bent toward the feeding point 141A with respect to the straight portion 151. In other words, the straight portions 152 and 153 that extend in Y axis direction are bent in negative X direction. Angles θ at which the straight portions 152 and 153 are bent with respect to the central axis of the straight portion 151 are equal to each other. The angle is one example of the bent degree.

In the conductive strip 150 as described above, the center point of the straight portion 151 in Y axis direction corresponds to the position at which the node of the standing wave formed on the meander conductive line 140 occurs in plan view. Accordingly, the eleven conductive strips 150 are disposed on the dielectric layer 120 so that the eleven conductive strips 150 intersect the meander conductive line 140 at the positions of the eleven nodes of the standing wave of the current formed on the meander conductive line 140, respectively, in plan view.

In each of the conductive strips 150, length from an end portion of the straight portion 152 to an end portion of the straight portion 153 along the straight portions 152, 151 and 153 is set to a length corresponding to the single wavelength (λ) at the resonant frequency. Therefore, the conductive strips 150 function as resonators. Thickness of the dielectric layer 120 is set to a thickness that does not suppress the electromagnetic coupling of the conductive strips 150 and the meander conductive line 140.

Therefore, the conductive strips 150 function as resonators that are electromagnetically coupled with the meander conductive line 140. Each of the conductive strips 150 can radiate and receive electromagnetic waves via the meander conductive line 140 and can perform communications at the resonant frequency.

Each of the nodes of the standing wave of current is a point where current value becomes zero and electric field becomes the maximum value. Accordingly, it becomes possible to increase electric field intensity in positive Z axis direction side of the microstrip antenna including the meander conductive line 140 by utilizing the conductive strips 150.

Since the conductive strips 150 are arranged on the top surface of the antenna apparatus 100 in a manner that the conductive strips 150 encompasses the whole top surface of the antenna apparatus 100 in X axis direction and Y axis direction, it is possible to increase and make uniform the electric field intensity on the top surface side of the antenna apparatus 100.

Next, lengths and angles θ of the conductive strips 150A1, 150A2, 150B1, 150B2, 1501C1, 150C2, 150D1, 150D2, 150E1, 150E2 and 150E3 will be described.

The lengths of the conductive strips 150A1 and 150A2 are equal to each other and are set to 186 mm, for example. The lengths of the conductive strips 150E1, 150E2 and 150E3 are equal to each other and are set to 202 mm, for example. The lengths of the conductive strips 150A1, 150A2, 150E1, 150E2 and 150E3, i.e. 186 mm and 202 mm, are lengths corresponding to the single wavelength at the resonant frequency.

The lengths of the conductive strips 150B1 and 150B2 are equal to each other. The lengths of the conductive strips 150C1 and 150C2 are equal to each other. The lengths of the conductive strips 150D1 and 150D2 are equal to each other. The lengths of the conductive strips 150B1 and 150B2, the lengths of the conductive strips 150C1 and 150C2 and the lengths of the conductive strips 150D1 and 150D2 are longer than 186 mm and shorter than 202 mm. The lengths of the conductive strips 150B1 and 150B2, the lengths of the conductive strips 150C1 and 150C2 and the lengths of the conductive strips 150D1 and 150D2 increase in this order. These three lengths correspond to the single wavelength at the resonant frequency as well.

In each of the conductive strips 150, length of the straight portion 151 is 60 mm, and lengths of the straight portions 152 and 153 are equal to each other.

As illustrated in FIG. 2, in the conductive strips 150A1 and 150A2, the angles θ of the straight portions 152 and 153 bent with respect to the central axis of the straight portion 151 are 30 degrees. In the conductive strips 150B1 and 150B2, the angles θ of the straight portions 152 and 153 bent with respect to the central axis of the straight portion 151 are 35 degrees.

In the conductive strips 150C1 and 150C2, the angles θ of the straight portions 152 and 153 bent with respect to the central axis of the straight portion 151 are 40 degrees. In the conductive strips 150D1 and 150D2, the angles θ of the straight portions 152 and 153 bent with respect to the central axis of the straight portion 151 are 45 degrees.

In the conductive strips 150E1, 150E2 and 150E3, the angles θ of the straight portions 152 and 153 bent with respect to the central axis of the straight portion 151 are 50 degrees.

The lengths and the angles θ were derived by an electromagnetic field simulation utilizing a Finite Element Method. The simulation result will be described later. More enhanced S11 parameter characteristics are obtained in a case where the lengths of the eleven conductive strips 150 are different as described above than in a case where the lengths of the eleven conductive strips 150 are the same.

A more uniform field distribution is obtained in a case where the lengths of the eleven conductive strips 150 are different as described above than in a case where the lengths of the eleven conductive strips 150 are the same. As illustrated in FIG. 2, the electric field Ed generated by the conductive strips 150 is divided into X component Ex obtained in X axis direction and Y component Ey obtained in Y axis direction. The reason why the more uniform field distribution is obtained in a case where the lengths of the eleven conductive strips 150 are different is because the Y component Ey is increased compared with the case where the lengths of the eleven conductive strips 150 are the same.

If the conductive strips 150 have straight-line-shapes extending along Y axis, the electric field Ed generated by the conductive strips 150 only have the X component Ex. In other words, in this case, Y component Ey is not generated by the conductive strips 150.

Accordingly, it is important for each of the conductive strips 150 that the straight portions 152 and 153 are bent at angle θ with respect to the straight portion 151 in order to obtain the Y component Ey. By setting the angles θ of the eleven conductive strips 150 to various angles as illustrated in FIG. 2, it becomes possible to obtain the Y components Ey with various intensities and to obtain a more uniform field distribution.

According to the first embodiment, it is possible to provide the antenna apparatus 100 which can generate the electric field having sufficient uniformity and intensity in the near field by electromagnetically coupling the conductive strips 150 that function as the resonators and the microstrip antenna including the meander conductive line 140 and the ground plane 130. The antenna apparatus 100 which can generate an electric field having sufficient uniformity and intensity in a near field is provided.

According to the embodiment as described above, the conductive strips 150A1, 150A2, 150B1, 150B2, 15001, 25002, 15001, 15002, 150E, 150E2 and 150E3 are disposed at positions that are located designated distances away from the ground point 143A, respectively.

The positions are located λ/4, 3λ/4, 5λ/4, 7λ/4, 9λ/4, 11λ/4, 13λ/4, 15λ/4, 17λ/4, 19λ/4 and 21λ/4 away from the ground point 143A, respectively.

Accordingly, the length between the conductive strips 150A1, 150A2, 150B1, 150B2, 150C1, 150C2, 150D1, 150D2, 150E1, 150E2 and 150E3 are lengths corresponding to μ/2 at the resonant frequency.

Accordingly, currents flowing through the two neighboring conductive strips 150 among the conductive strips 150A, 150A2, 150B1, 150B2, 150C1, 150C2, 150D1, 150D2, 150E1, 150E2 and 150E3 have opposite phases with each other.

According to a variation example of the first embodiment, the antenna apparatus 100 may include only the conductive strips 150A1, 150B1, 150C1, 150D2, 150E1 and 150E3. In this case, the currents flowing through the two neighboring conductive strips 150 have the same phases with each other. Accordingly, it is possible to provide a configuration in which the electric fields generated by the conductive strips 150A1, 150B1, 150C1, 150D1, 150E1 and 150E3 strengthen one another.

It is possible to manufacture the antenna apparatus 100 as described above as follows. First of all, prepare a sheet of substrate material to which copper foils are attached on both surfaces of the substrate material. Form the meander conductive line 140 by patterning one of the copper foils and keeping the other copper foil as the ground plane 130. Accordingly, a first structural body which includes the dielectric layer 110, the ground plane 130 and the meander conductive line 140 is obtained.

Next, prepare another sheet of substrate material to which one copper foil is attached on a surface of the substrate material. Form the conductive strips 150 by patterning the copper foil. Accordingly, a second structural body which includes the dielectric layer 120 and the conductive strips 150 is obtained.

Then, put the top surface of the first structural body and the bottom surface of the second structural body together. Accordingly, the antenna apparatus 100 is completed. The dielectric layer 110 and the dielectric layer 120 may be put together by thermocompression bonding, adhesive bonding or the like.

According to the embodiment as described above, the ground plane 130, the meander conductive line 140 and the conductive strips 150 are made of copper. However, the ground plane 130, the meander conductive line 140 and the conductive strips 150 may be made of metal such as gold, silver, nickel or the like, or an alloy of these metals.

A cover member which covers the bottom surface of the ground plane 130 may be attached to the antenna apparatus 100. The cover member may be made of resin, for example, and may have similar dimensions in X axis direction and Y axis direction to those of the dielectric layer 110. Similarly, a cover member which covers the conductive strips 150 and the top surface of the dielectric layer 120 may be attached to the antenna apparatus 100. The cover member may be made of resin, for example, and may have similar dimensions in X axis direction and Y axis direction to those of the dielectric layer 120.

Next, a variation example of the antenna apparatus 100 according to the first embodiment will be described with reference to FIGS. 7A, 7B, 7C, 7D and 7E.

FIGS. 7A, 7B, 7C, 7D and 7E are diagrams illustrating conductive strips 171 to 175 of the variation example of the antenna apparatus 100 according to the first embodiment, respectively. The conductive strips 171 to 175 as illustrated in FIGS. 7A to 7E may be used instead of the conductive strips 150 as illustrated in FIGS. 1 to 6.

Figure 7A:
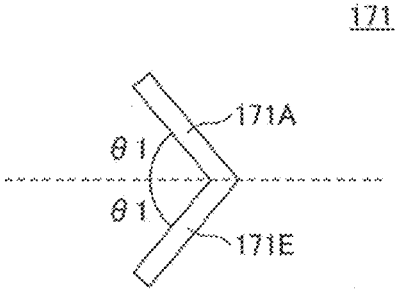
FIG. 7A is a diagram illustrating conductive strips 171 to 175 of the variation example of the antenna apparatus 100 according to the first embodiment.

As illustrated in FIG. 7A, the conductive strip 171 includes straight portions 171A and 171B. The straight portions 171A and 171E are bent at angles θ1 with respect to the central axes of the dielectric layers 110 and 120 that are described by a dashed line and are parallel with X axis. The angles θ1 may be greater than 0 degrees and less than 90 degrees.

As illustrated in FIG. 78, the conductive strip 172 includes straight portions 172A, 172B, 172C and 172D. The straight portions 172A and 172B are bent at angles θ2 with respect to the central axes of the dielectric layers 110 and 120 that are described by the dashed line and are parallel with X axis. The angles θ2 may be greater than 0 degrees and less than 90 degrees.

The straight portions 172C and 172D are formed from end portions of the straight portions 172A and 172B, respectively, in a continuous fashion. The straight portions 172C and 172D are bent with respect to the straight portions 172A and 1728 so that the straight portions 172C and 172D face toward the feeding point 141A (see FIGS. 1 and 2) more than the straight portions 172A and 172B.

Figure 7D:
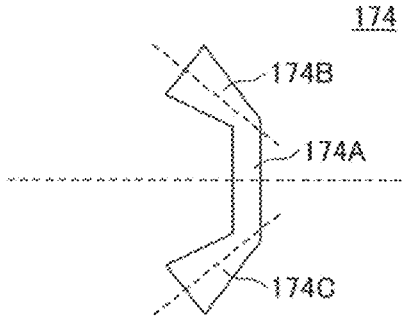
FIG. 7D is a diagram illustrating conductive strips 171 to 175 of the variation example of the antenna apparatus 100 according to the first embodiment.
Figure 7B:
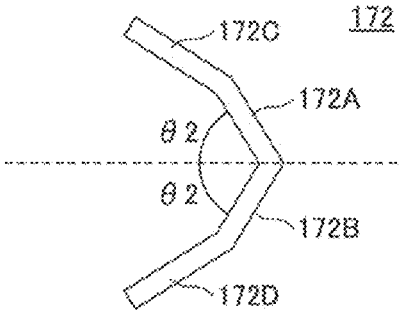
FIG. 7B is a diagram illustrating conductive strips 171 to 175 of the variation example of the antenna apparatus 100 according to the first embodiment.
Figure 7E:
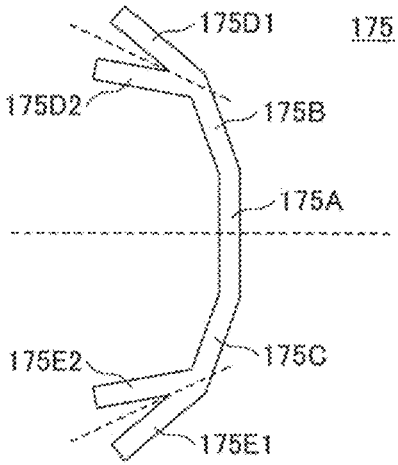
FIG. 7E is a diagram illustrating conductive strips 171 to 175 of the variation example of the antenna apparatus 100 according to the first embodiment.
Figure 7C:
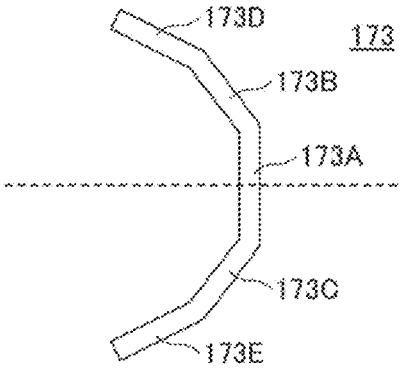
FIG. 7C is a diagram illustrating conductive strips 171 to 175 of the variation example of the antenna apparatus 100 according to the first embodiment.

As illustrated in FIG. 7C, the conductive strip 173 includes straight portions 173A, 173B, 173C, 173D and 173E. The straight portion 173A extends in Y axis direction in a similar manner to that of the straight portion 151 of the conductive strips 150 as illustrated in FIGS. 1 to 6.

The straight portions 173B and 173C are formed from both end portions of the straight portion 1731A, respectively, in a continuous fashion. The straight portions 173B and 173C are bent with respect to the straight portion 173A so that the straight portions 173B and 173C face toward the feeding point 141A see FIGS. 1 and 2).

The straight portions 173D and 173E are formed from end portions of the straight portions 173B and 173C, respectively, in a continuous fashion. The straight portions 173D and 173E are bent with respect to the straight portions 173B and 173C so that the straight portions 173D 173E face toward the feeding point 141A (see FIGS. 1 and 2) more than the straight portions 173B and 173C.

As illustrated in FIG. 7D, the conductive strip 174 includes straight portion 174A and tapered portion 174B and 171. The straight portion 174A extends in Y axis direction in a similar manner to that of the straight portion 151 of the conductive strips 150 as illustrated in FIGS. 1 to 6.

The tapered portion 174B and 174C are formed from both end portions of the straight portion 174A, respectively, in a continuous fashion. The tapered portions 174B and 174C are bent with respect to the straight portion 174A so that central axes of the tapered portion 174B and 174C face toward the feeding point 141A (see FIGS. 1 and 2).

As illustrated in FIG. 7E, the conductive strip 175 includes straight portions 175A, 175B and 175C and branch portions 175D and 175E. The straight portions 175A, 175B and 175C are similar to the straight portion 173A, 173B and 173C as illustrated in FIG. 7C.

The branch portions 175D an 175E are formed from end portions of the straight portions 173B and 173C in a continuous fashion and branch into two portions, respectively. The branch portions 175D and 175E are bent with respect to the straight portions 175B and 175C so that central axes of the branch portions 175D and 175E face toward the feeding point 141A (see FIGS. 1 and 2) more than the straight portions 175B and 175C.

The conductive strips 171*i* to 175 as illustrated in FIGS. 7A to 7E may be used instead of the conductive strips 150 as illustrated in FIGS. 1 to 6. The angles or number of branches may not be limited to those illustrated in FIGS. 7A to 7E, and may be changed in various way. However, it is preferable for the conductive strips 171 to 175 to be bent toward the feeding point 141A (see FIGS. 1 and 2).

Accordingly, the conductive strips 150 may be bent or rounded with respect to Y axis direction in a non-linear fashion.

According to the embodiment as described above, the conductive strips 115 are bent or rounded with respect to Y axis direction in non-linear fashion, and the conductive strips 150 may extend along Y axis direction in a linear fashion as long as sufficient electric, field in the near field can be obtained.

Next, a shelf antenna system utilizing the antenna apparatus 100 according no the first embodiment will be described with reference to FIG. 8.

Figure 8:
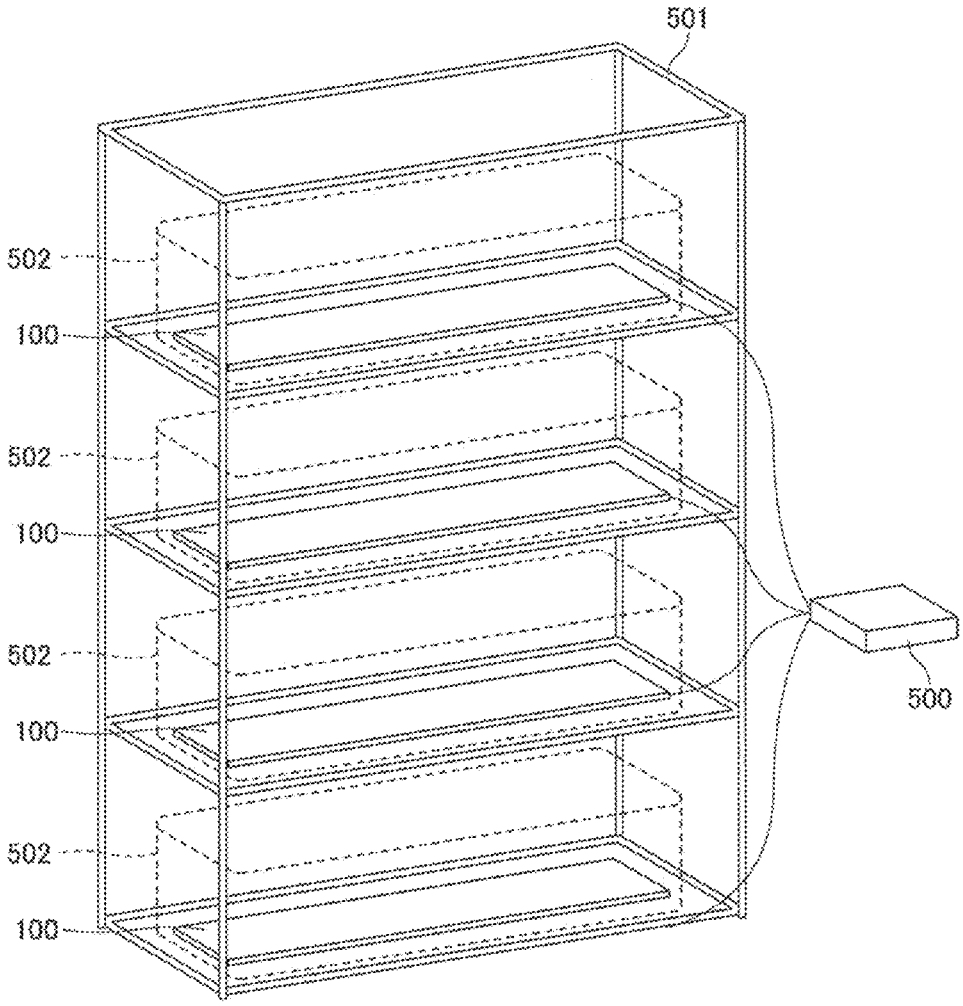
FIG. 8 is a diagram illustrating the shelf antenna system utilizing the antenna apparatuses 100 according to the first embodiment.

FIG. 8 is a diagram illustrating the shelf antenna system utilizing the antenna apparatuses 100 according to the first embodiment. In the shelf antenna system as illustrated in FIG. 8, four antenna apparatuses 100 are connected to a reader-writer 500 and are disposed on each level of a four-level shelf 501. Since the antenna apparatus 100 can perform communications in the near field, readable areas 502 are formed at each level, of the shelf 501.

In such a shelf antenna system, merchandises to which RFID tags are attached are arranged on the antenna apparatuses 100 provided on each of the shelf 501. In this condition, the reader-writer 500 reads the RFID tags. The shelf antenna system identifies that at least one of the merchandise items is taken away from the shelf 501 when the shelf antenna system becomes unable to detect one or more of the REID tags. The reader-writer 500 can not read the RFID tag when the merchandise is taken away from the readable areas.

Second Embodiment

Figure 9:
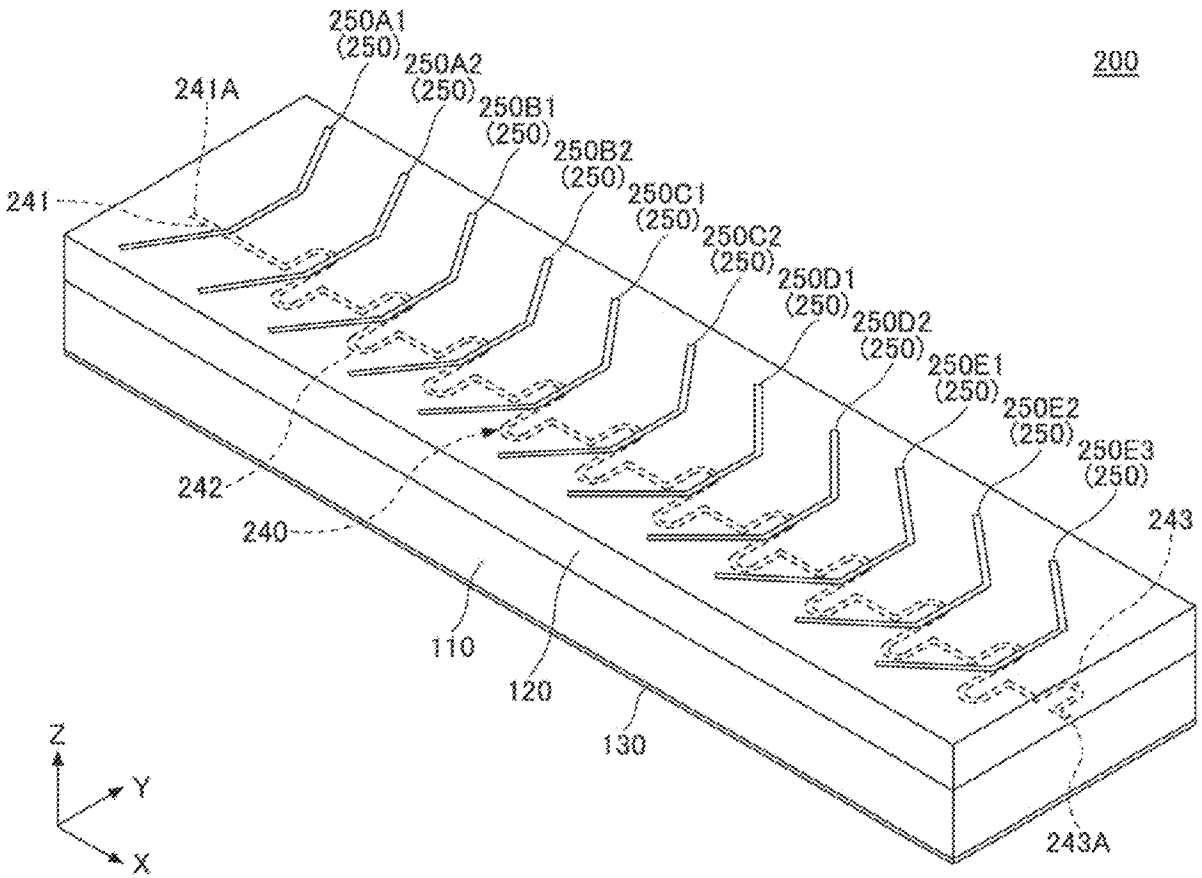
FIG. 9 is an oblique perspective diagram illustrating an antenna apparatus 200 of the second embodiment.
Figure 10:
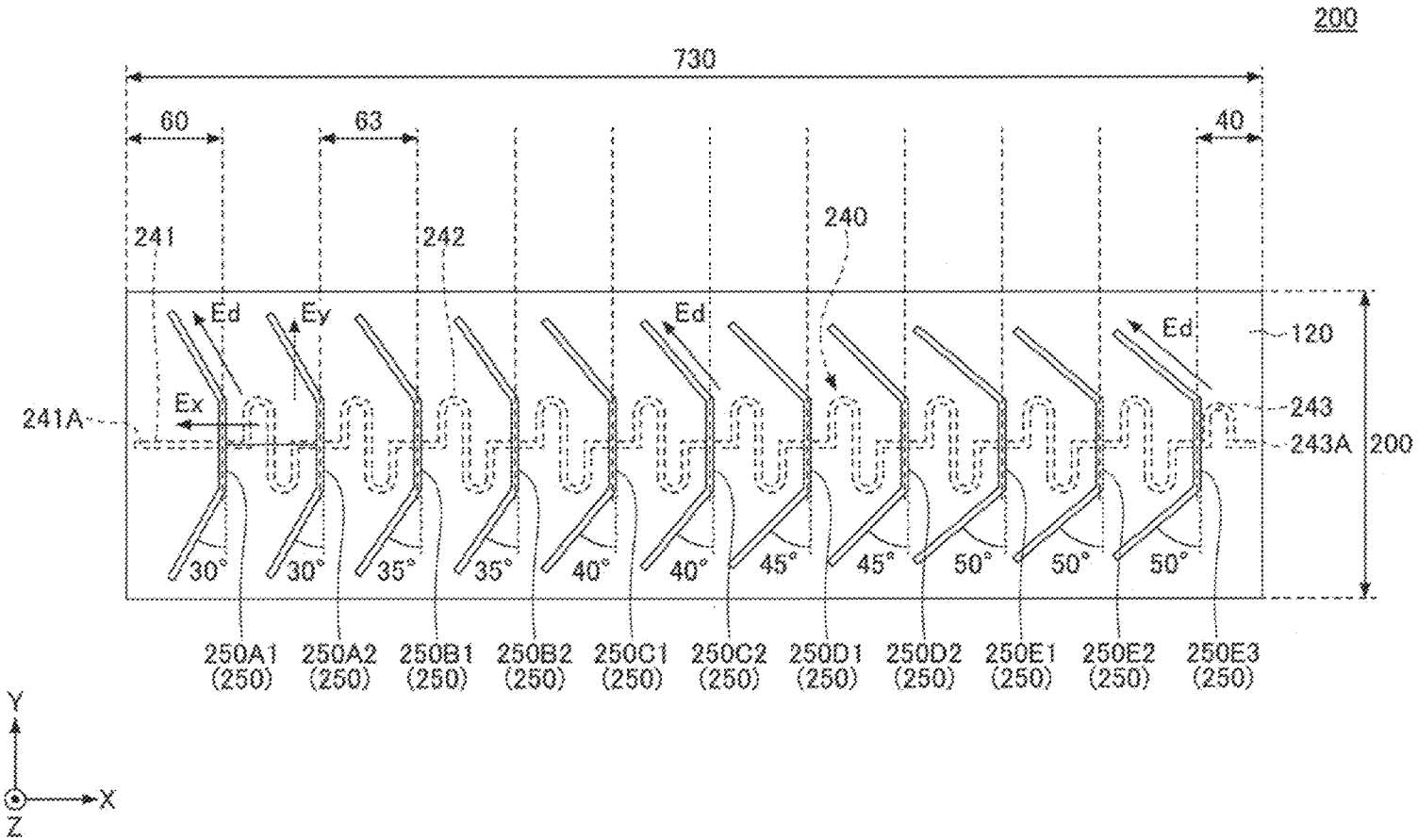
FIG. 10 is a diagram illustrating the antenna apparatus 200 of the second embodiment in plan view.

FIG. 9 is an oblique perspective diagram illustrating an antenna apparatus 200 of the second embodiment. FIG. 10 is a diagram illustrating the antenna apparatus 200 of the second embodiment in plan view if the apparatus 200 according to the second embodiment, configuration elements corresponding to the meander conductive line 140 and the conductive strips 150 of the antenna apparatus 100 according to the first embodiment are changed.

Accordingly, the same elements as or elements similar to those of the antenna apparatus 100 of the first embodiment are referred to by the same reference numerals, and a description thereof is omitted. In FIG. 10, principal dimensions are illustrated.

The antenna apparatus 200 includes the dielectric layers 110 and 120, the ground plane 130, a meander conductive line 240 and conductive strips 250. The antenna apparatus 200 includes eleven conductive strips 250. In a case where the eleven conductive strips 250 are distinguished from each other, the eleven conductive strips 250 are referred to as conductive strips 250A1, 250A2, 250B1, 250B2, 250C1, 250C2, 250D1, 250D2, 250E2, 250E2 and 250E3. In a case where the conductive strips 250A1 to 250E3 are not distinguished from each other, the conductive strips 250A1 to 250E3 will be described as the conductive strips 250.

In the meander conductive line 240, a meander shape is rounded whereas a meander shape of the meander conductive line 140 of the first embodiment is bent at a right angle. The meander conductive line 240 includes an open end 243A instead of the ground point 143A of the meander conductive line 140 of the first embodiment.

The meander conductive line 240 is disposed on the top surface of the dielectric layer 110. The meander conductive line 240 is one example of a first conductive line. The meander conductive line 140 constitutes the microstripline with the ground plane 130. The microstripline functions as a microstrip, antenna.

The meander conductive line 240 includes a straight portion 241, meander portions 242 and an adjust portion 243. The straight portion 241 extends in X axis direction. An and portion of the straight portion 241 located in negative X direction side constitutes a first end of the meander conductive line 240, and constitutes a feeding point 241A. This is similar to the straight portion 141 of the first embodiment. Length of the straight portion 241 is 60 mm, for example.

Ten meander portions 242 are connected in series with each other between the straight portion 241 and the adjust portion 243 in a similar manner to those of the ten meander portions 142 of the first embodiment. Since the ten meander portions 242 have similar configurations to those of the meander portions 142, the meander portions 242 will be described with reference to FIG. 11. The adjust portion 243 will be described with reference to FIG. 12.

Figure 11:
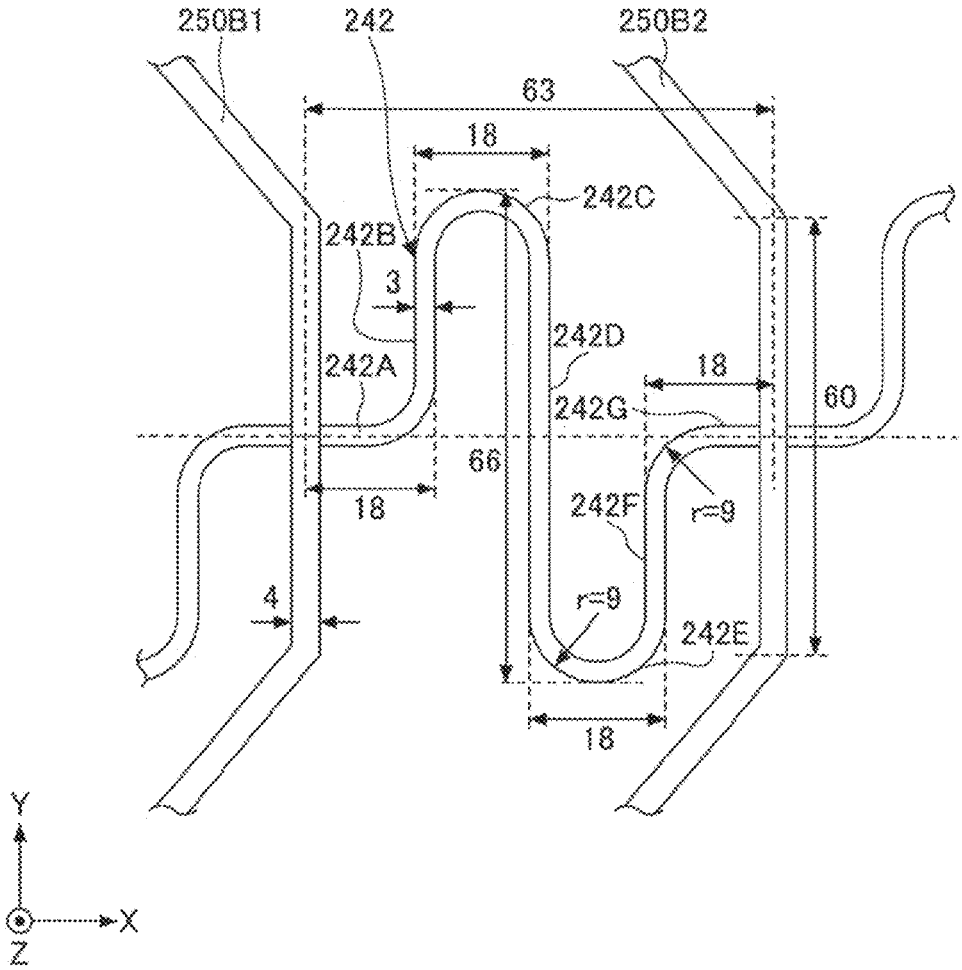
FIG. 11 is a diagram illustrating the meander portion 242 of the second embodiment in plan view.

FIG. 11 is a diagram illustrating the meander portion 242 of the second embodiment in plan view. In FIG. 11, the meander portion 242 located between the conductive strips 250B1 and 250B2 are illustrated.

The meander portion 242 includes line portions 242A, 242B, 242C, 242D, 242E, 242F and 242G. As illustrated in FIG. 11, connecting portions of the line portions 242A, 242B, 242C, 242D, 242E, 242F and 242G are rounded in plan view.

Straight portions and rounded portions included in the line portions 242A, 242B, 242C, 242D, 242E, 242F and 242G have the same width. The width is 3 mm; for example. Radius of curvature of the rounded portions is 9 mm, for example. The radius of curvature is one example of the rounded degree. As illustrated in FIG. 11, the line portions 242A, 242B, 242C, 242D, 242E, 242F and 242G may have dimensions other than the dimensions as described above, for example. Unit of measures as illustrated in FIG. 11 is mm.

Line length from a first end at which the meander portion 242 intersects the conductive strip 250B1 to a second end at which the meander portion 242 intersects the conductive strip 250B2 is set to a length corresponding to the single wavelength (λ) at the resonant frequency. A gap between the conductive strips 250B1 and 250B2 is 63 mm, for example.

Figure 12:
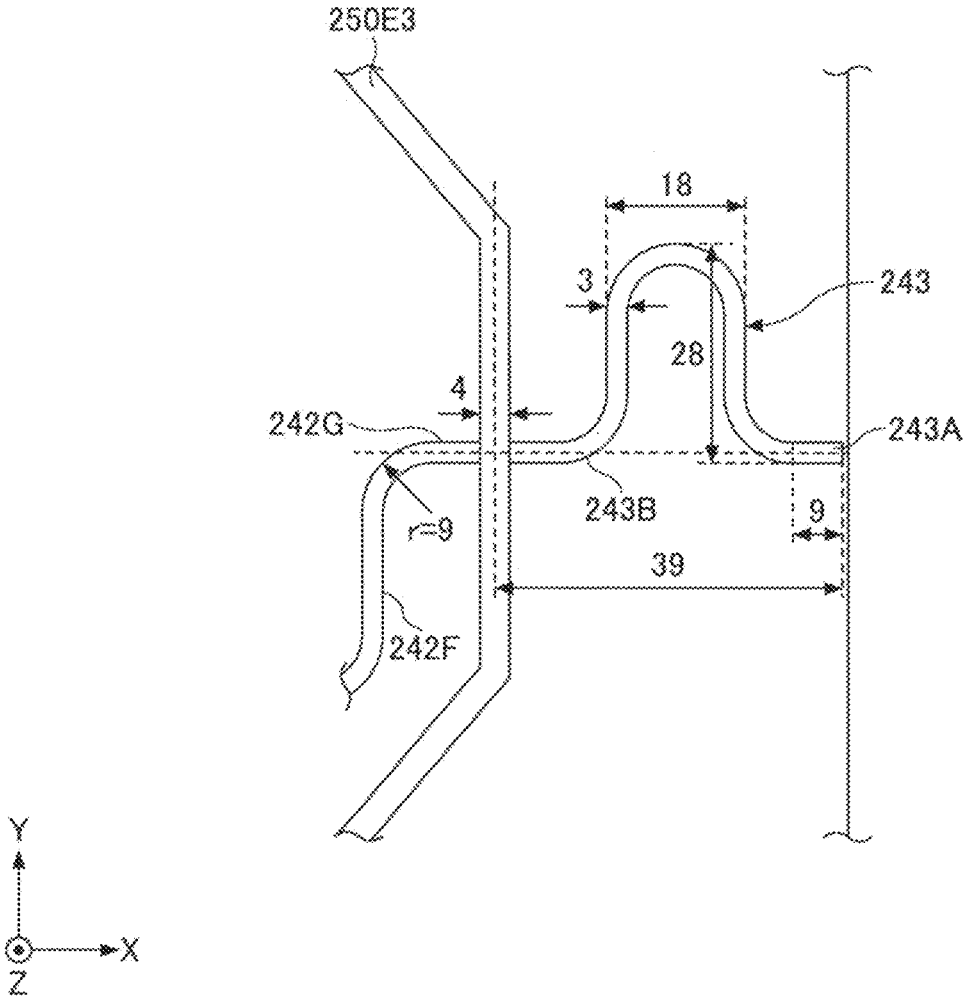
FIG. 12 is a diagram illustrating the adjust portion 243 of the second embodiment in plan view.

FIG. 12 is a diagram illustrating the adjust portion 243 of the second embodiment in plan view.

A first end of the adjust portion 243 is connected to a second end of the farthest meander portion 242 from the feeding point 241A, and a second end of the adjust portion 243 is the open end 243A. The open end 243A is opened and is not electrically connected to anything.

The adjust portion 243 extends from the first end in positive X direction, is rounded in circular arc shape, extends in positive Y direction, is rounded in circular arc shape, extends in negative Y direction, is rounded in circular arc shape and extends in positive X direction to the open end 243A in plan view.

Length of the adjust portion 243 between the first end and the second end is set to a length corresponding to the half wavelength (λ/2) at the resonant frequency. Width of the adjust portion 243 is constant from the first end to the second end, and is 3 mm, for example. The adjust portion 243 has dimensions as illustrated in FIG. 12. Unit of measures as illustrated in FIG. 12 is mm.

The line length of the adjust portion 243 including the open end 243A is set to half wavelength (λ/2) at the resonant frequency. Accordingly, if electrical power is fed into the meander conductive line 240 from the feeding point 241A, current flowing through the meander conductive line 240 is reflected at the open end 243A and a standing wave of the current is formed on the meander conductive line 240.

Nodes of the standing wave occur at eleven locations that are λ/2, λ, 3λ/2, 2/λ, 5λ/2, 3λ, 7λ/2, 4λ, 9λ/2, 5λ and 11λ/2 away from the open end 243A, respectively. These lengths are obtained by multiplying integer numbers by the half wavelength at the resonant frequency, respectively.

In other words, the eleven nodes occur at a boundary between the straight portion 241 and the meander portion 242, nine boundaries between the ten meander portions 242, and a boundary between the meander portion 242 and the adjust portion 243, respectively.

Each of the nodes of the standing wave of current is a point where current value becomes zero and electric field becomes the maximum value. In the antenna apparatus 200 of the second embodiment, the conductive strips 250 are disposed on the meander conductive line 240 via the dielectric layer 120 and intersect the meander conductive line 240 at the locations of the nodes of the standing wave of the current, in order to electromagnetically couple the meander conductive line 240 and the conductive strips 250 and to maximize the electric field generated by the conductive strips 250.

The microstrip antenna including the meander conductive line 240 makes it possible to perform communications in the near field by utilizing the electric field which leaks from the top surface of the microstrip antenna. Herein, the electric field which leaks from the top surface of the microstrip antenna is referred to as leak electric field.

Although the eleven conductive strips 250 as illustrated in FIG. 9 have three straight portions, respectively, in a manner similar to that of the conductive strips 150 as illustrated in FIG. 3, lengths and angles θ of the eleven conductive strip 250 are different from the lengths and the angles θ of the conductive strips 150.

Hereinafter, the lengths of the conductive strips 250A1, 250A2, 250B1, 250B2, 250C1, 250C2, 250D1, 250D2, 250E1, 250E2 and 250E3 are referred to as L21, L22, L23, L24, L25, L26, L27, L28, L29, L30 and L31, respectively.

The angles θ of the straight portions included in the conductive strips 250A1, 250A2, 250B1, 250B2, 250C1, 250C2, 250D1, 250D2, 250E1, 250E2 and 250E3 will be referred to as angles θ21, θ22, θ23, θ24, θ25, θ26, θ27, θ28, θθ29, θ30 and θ31, respectively.

The lengths L21 and L22 are 173 mm, for example. The lengths L23 and L24 are 175 mm, for example. The lengths L25 and L26 are 177 mm, for example. The lengths L27 and L28 are 175 mm, for example. The lengths L29, L30 and L31 are 173 mm, for example.

As described above, according to the antenna apparatus 200 of the second embodiment, the lengths L25 and L26 of the conductive strips 250C1 and 250C2 that are disposed in the middle in X axis direction are the longest. On the other hand, the lengths L21, L22, L29, L30 and L31 of the conductive strips 250A2, 250A2, 250E1, 250E2 and 250E3 that are disposed on both ends in X axis direction are the shortest.

Herein, the lengths L21, L22, L23, L24, L25, L26, L27, L28, L29, L30 and L31 are lengths corresponding to the single wavelength (λ) at the resonant frequency.

The angles θ21 and θ22 are 30 degrees, for example. The angles θ23 and θ24 are 35 degrees, for example. The angles θ25 and θ26 are 40 degrees, for example. The angles θ27 and θ28 are 45 degrees, for example. The angles θ29, θ30 and θ31 are 50 degrees, for example.

As described above, the angles θ21~θ31 of the conductive strips 250A1, 250A2, 250B1, 250B2, 250C1, 250C2, 250D1, 250D2, 250E1, 250E2 and 250E3 becomes smaller in an area closer to the feeding point 241A and escomes larger in an area closer to the open end 243A.

The lengths L21 to L31 and the angles θ21 to θ31 are derived from the electromagnetic simulation utilizing the Finite Element Method.

Herein, for the sake of validating an effect of the different lengths 121 to 131 of the conductive strips 250A1 to 250E3 as described above, a comparison result of the S11 parameter of the antenna apparatus 200 according to the second embodiment and the S11 parameter of an antenna apparatus of a comparative example will be described with reference to FIG. 13. In the antenna apparatus of the comparative example, the lengths L21 to L31 are set to 186 mm.

Figure 13:
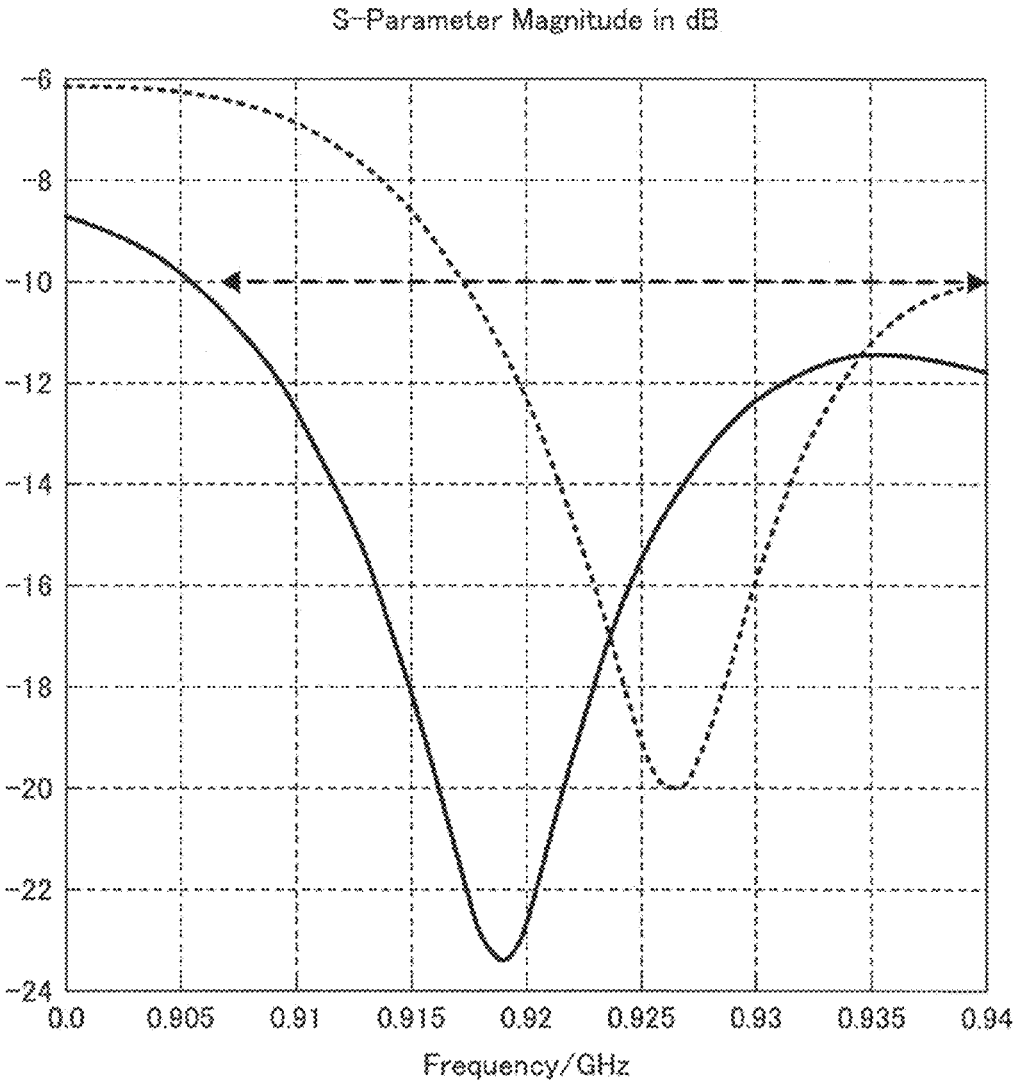
FIG. 13 is a diagram illustrating frequency characteristics of the S11 parameter of the antenna apparatus 200 according to the second embodiment and the S11 parameter of the antenna apparatus of the comparative example.

FIG. 13 is a diagram illustrating frequency characteristics of the S11 parameter of the antenna apparatus 200 according to the second embodiment and the S11 parameter of the antenna apparatus of the comparative example.

In FIG. 13, a solid line represents the frequency characteristics of the S11 parameter obtained from the antenna apparatus 200. A dashed line represents the frequency characteristics of the S11 parameter obtained from the antenna apparatus of the comparative example. In the antenna apparatus of the comparative example, the lengths L21 to L31 of the eleven conductive strips 250A1 to 250E3 are set to 186 mm.

Both S11 parameters are calculated under a condition where values of S11 parameter of the antenna apparatus 200 and the S11 parameter of antenna apparatus of the comparative example take almost the same values at 935 MHz. A criterion value of S11 parameter is −10 dB.

As illustrated in FIG. 13, a bandwidth in which the value of S11 parameter of the antenna apparatus 200 is less than or equal to −10 dB is wider than that of the antenna apparatus of the comparative example.

Accordingly, it becomes possible to widen the bandwidth by setting the lengths L21 to L31 of the conductive strips 250A1 to 250E3 to the different lengths as described above.

Next is discussed a simulation result of an electric field vector obtained at a point 400 mm high from the top surface of the dielectric layer 110 of the antenna apparatus 200 while varying a phase ϕ of the input signal fed into the feeding point 241A of the antenna apparatus 200.

Figure 14:
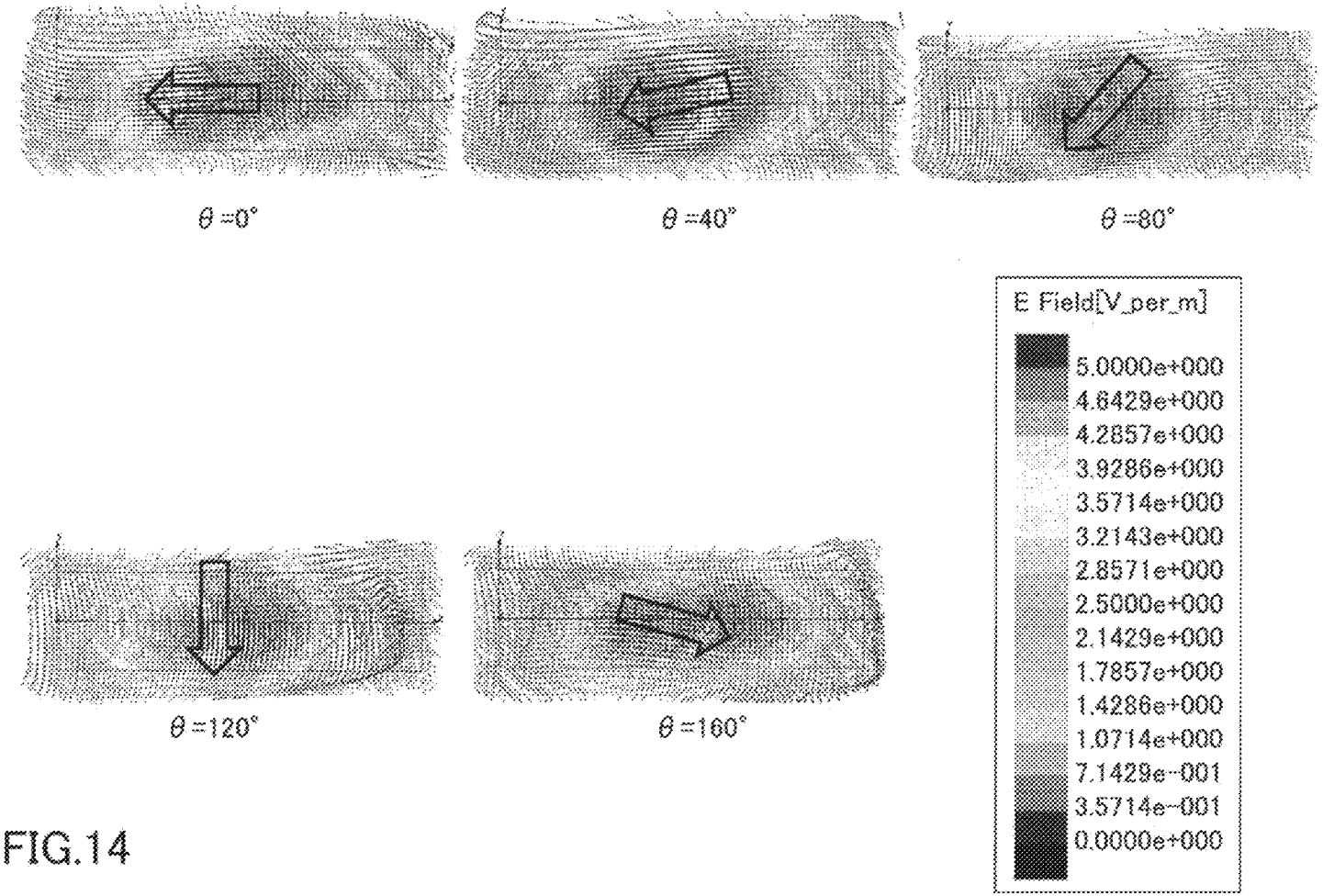
FIG. 14 is a diagram illustrating the simulation results of the electric field vector of the antenna apparatus 200.
Figure 15:
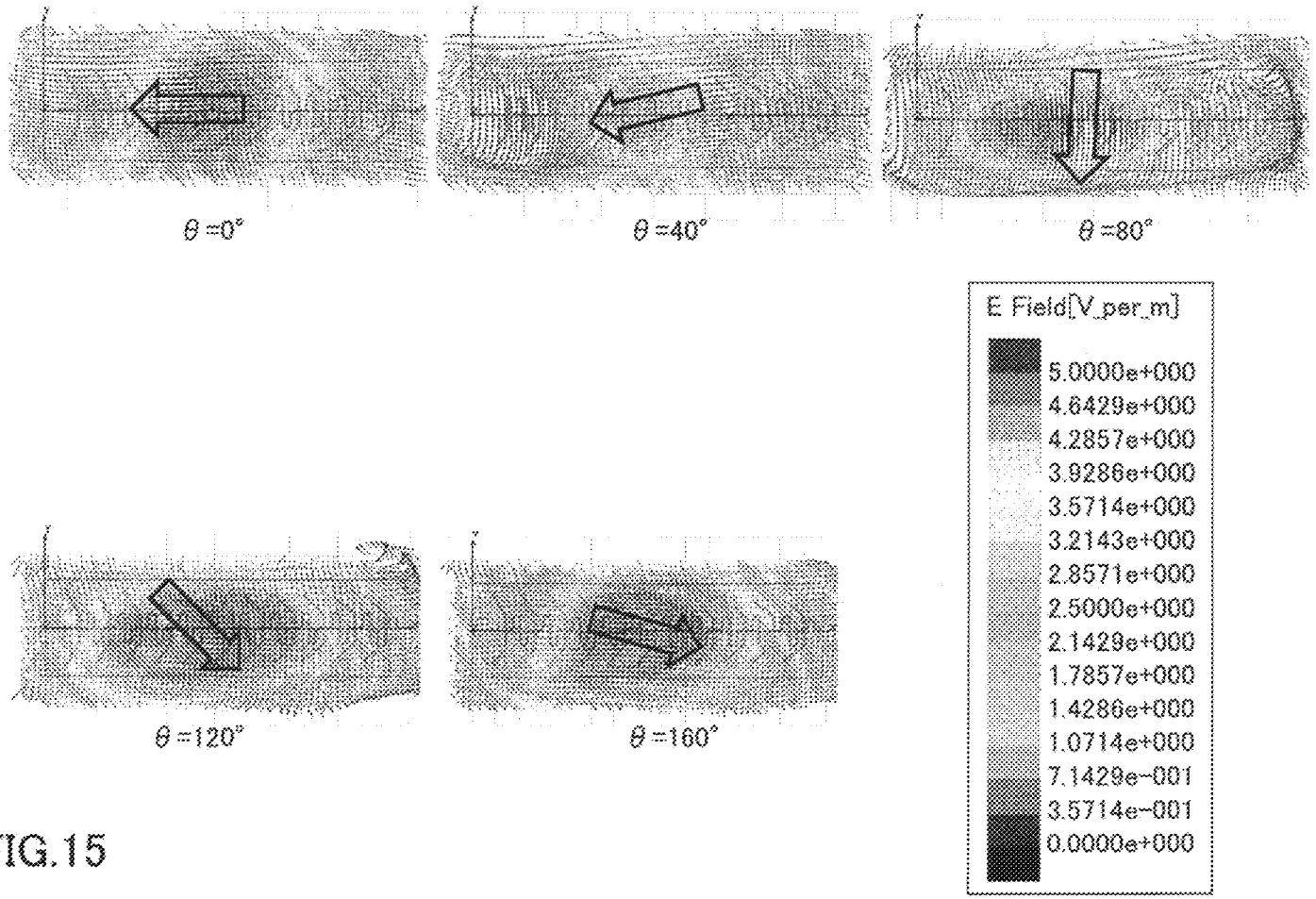
FIG. 15 is a diagram illustrating the simulation results of the electric field vector of the antenna apparatus 200.
Figure 16:
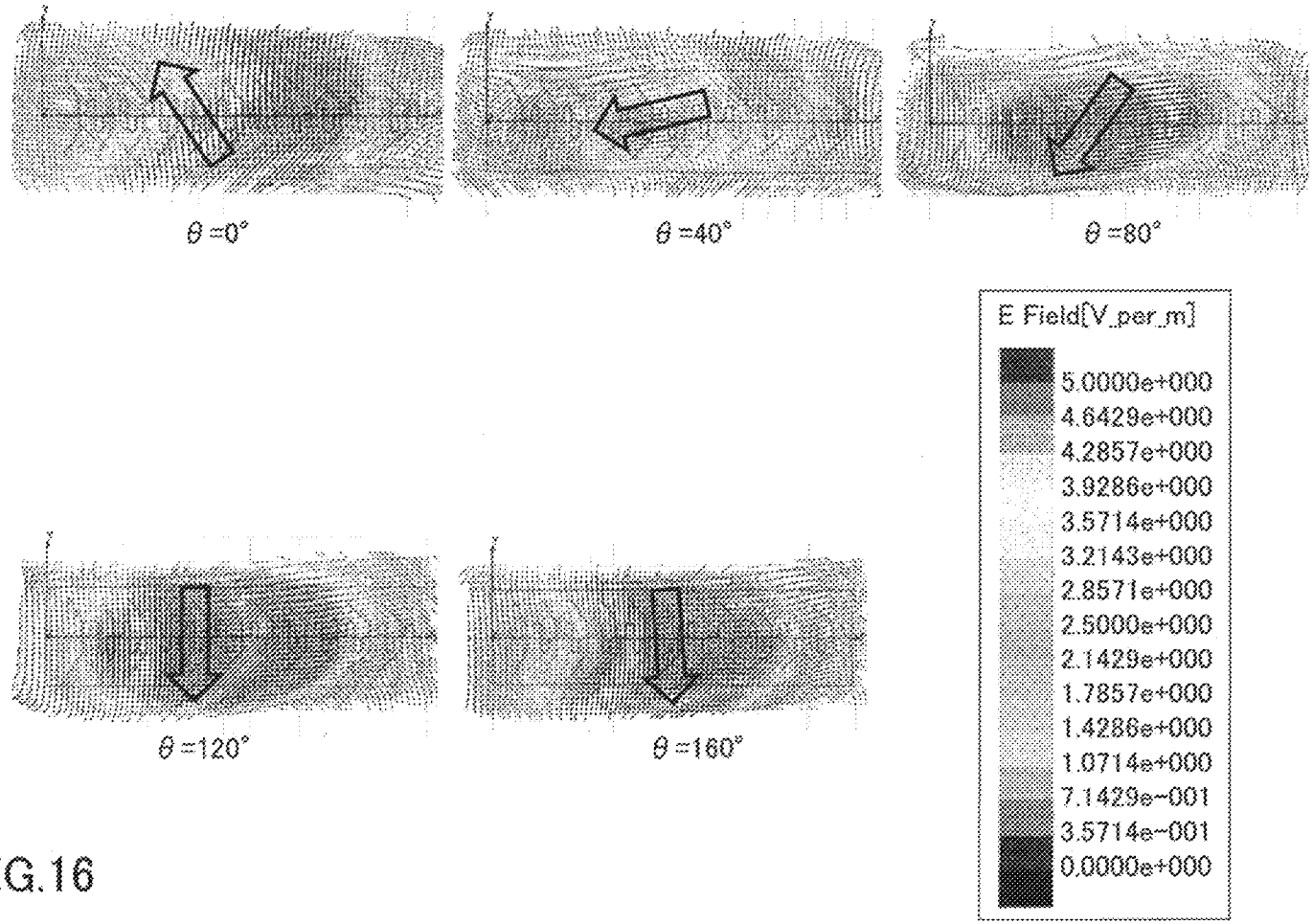
FIG. 16 is a diagram illustrating the simulation results of the electric field vector of the antenna apparatus 200.

FIGS. 14 to 16 are diagrams illustrating the simulation results of the electric field vector of the antenna apparatus 200. FIGS. 14 to 16 illustrate the simulation results of the electric field vector of the antenna apparatus 200 to which the input signals of 919 MHz, 910 MHz and 930 MHz are fed into the feeding point 241A, respectively.

Each of FIGS. 14 to 16 illustrates the five simulation results of the electric field vector of the antenna apparatus 200 at moments when the phase ϕ becomes 0 degrees, 40 degrees, 80 degrees, 120 degrees and 160 degrees, respectively. In these Figs., distributions and directions of the electric field vector are illustrated. The phase ϕ of the input signal represents a phase during one cycle (360 degrees) at 919 MHz, 910 MHz and 930 MHz.

In actual simulation results, the electric field intensities are represented in full color, i.e. 0 V/m is indicated by blue (see the bottom of legend in FIGS. 14 to 16) and 5 V/m is indicated by red (see the bottom of legend in FIGS. 14 to 16). Since the electric field intensities are represented by achromatic color in FIGS. 14 to 16, it is not possible to distinguish 5 V/m and 0 V/m.

However, the strong electric fields that are represented in red in the actual simulation results are located in a central portion of the antenna apparatus 200 in plan view, and the weak electric fields that are represented in blue in the actual simulation results are located in the peripheral portion of the antenna apparatus 200 in plan view.

Accordingly, large arrows that represent principal directions of the strong electric field are added to the central portions in FIGS. 14 to 16.

As illustrated in FIG. 14, when the phase ϕ of the input signal of 919 MHz is 0 degrees, the principal directions of the strong electric fields that occur in the central portion of the antenna apparatus 200 are negative X axis direction.

As the phase ϕ of the input signal of 919 MHz varies to 40 degrees, 80 degrees, 120 degrees and 160 degrees, the principal directions of the strong electric fields vary in counterclockwise direction. When the phase ϕ of the input signal of 919 MHz is 160 degrees, the principal directions of the strong electric fields are positive X axis direction.

This means that the principal directions of the strong electric fields that occur on the top surface of the antenna apparatus 200 rotate in a circular polarization manner as the phase ϕ of the input signal varies.

An inclination such as this can be seen in a case where the input signals of 910 MHz and 930 MHz are input to the feeding point 241A of the antenna apparatus 200 as illustrated in FIGS. 15 and 16.

According to the second embodiment, it is possible to provide the antenna apparatus 200 which generate the electric field of which the direction rotates in a circular polarization manner as the phase ϕ of the input signal of 919 MHz, 910 MHz and 930 MHz varies.

As described above, the direction of the electric field generated on the surface of the antenna apparatus 200 varies in response to the phase ϕ of the input signal. Accordingly, it is possible to read the identification information of the RFID tag which is attached to the merchandise arranged on the shelf 501 in a state where the antenna apparatus 200 is provided on the shelf 502, even if the merchandise is disposed on the shelf 501 in any direction.

According to the second embodiment, it is possible to provide the antenna apparatus 200 which can generate the electric field having sufficient uniformity and intensity in the near field by electromagnetically coupling the conductive strips 250 that function as the resonators and the microstrip antenna including the meander conductive line 240 and the ground plane 130.

Although the simulation result as illustrated in FIGS. 13 to 16 are derived with respect to the antenna apparatus 200 of the second embodiment, it is presumed that similar result can be obtained with respect to the antenna apparatus 100 of the first embodiment.

The descriptions of the antenna apparatus of exemplary embodiments have been provided heretofore. The present invention is not limited to these embodiments, but various variations and modifications may be made without departing from the scope of the present invention.

So far, the preferred embodiments and modification of the antenna apparatuses are described. However, the invention is not limited to those specifically described embodiments and the modification thereof, and various modifications and alteration may be made within the scope of the inventions described in the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention.

Although the embodiments of the present invention have been described in detail, it should be understood that the various changes, substitutions, and alterations could be made hereto without departing from the spirit and scope of the invention.

What is claimed is:

1. An antenna apparatus comprising:

a first dielectric layer having a rectangular shape in plan view;

a ground plane configured to be disposed on a first surface of the first dielectric layer;

a conductive line configured to have a first end and a second end and to be disposed on a second surface of the first dielectric layer, the first end being a feeding point, the second end being an open end or a short end connected to the ground plane;

a second dielectric layer configured to have a shape corresponding to the first dielectric layer and to be disposed on the second surface of the first dielectric layer in a state where the conductive line is sandwiched between the first dielectric layer and the second dielectric layer, the second dielectric layer having a first surface facing toward the first dielectric layer and a second surface opposite to the first surface;

a first conductive element configured to be disposed on the second surface of the second dielectric layer so that the first conductive element intersects the conductive line at a first position corresponding to a first node of a standing wave of current flowing through the conductive line in plan view, respectively; and a second conductive element configured to be disposed on the second surface of the second dielectric layer so that the second conductive element intersects the conductive line at a second position corresponding to a second node of the standing wave in plan view, respectively, wherein the first conductive element and the second conductive element are bent or rounded toward the feeding point with respect to the first position and the second position corresponding to the first node and the second node in plan view, respectively, and wherein a first bent degree, a first rounded degree or a first length of the first conductive element is different from a second bent degree, a second rounded degree or a second length of the second conductive element.

2. The antenna apparatus as claimed in claim 1, wherein each of the first conductive element and the second conductive element are electromagnetically coupled with the conductive line, respectively, and wherein the first conductive element and the second conductive element constitute a resonator, respectively.

3. The antenna apparatus as claimed in claim 1, wherein the first length and the second length are set to lengths corresponding to a single wavelength at a resonant frequency, respectively.

4. The antenna apparatus as claimed in claim 1, wherein in a case where the second end of the conductive line is an open end, a length between the second end of the conductive line and the first position corresponds to a third length obtained by multiplying a first integer number by a half wavelength at resonant frequency, and a length between the second end of the conductive line and the second position corresponds to a fourth length obtained by multiplying a second integer number by the half wavelength at resonant frequency.

5. The antenna apparatus as claimed in claim 4, wherein the third length and the fourth length are obtained by multiplying odd numbers by the half wavelength at the resonant frequency, respectively.

6. The antenna apparatus as claimed in claim 1, wherein in a case where the second end of the conductive line is an open end, a length between the second end of the conductive line and the first position corresponds to a third length obtained by multiplying a first integer number by a half wavelength at resonant frequency and by subtracting a quarter wavelength at the resonant frequency from a first multiplied result of the first integer number and the half wavelength, and a length between the second end of the conductive line and the second position corresponds to a fourth length obtained by multiplying a second integer number by the half wavelength at resonant frequency and by subtracting the quarter wavelength at the resonant frequency from a second multiplied result of the second integer number and the half wavelength.

7. The antenna apparatus as claimed in claim 6, wherein the third length and the fourth length are obtained by multiplying odd numbers by the half wavelength at the resonant frequency and by subtracting the quarter wavelength at the resonant frequency from the first multiplied result and the second multiplied result, respectively.

8. The antenna apparatus as claimed in claim 1, wherein the first conductive element and the second conductive element include a first line and a pair of second lines, respectively, the first line of the first conductive element being configured to extend from the first position, the second lines of the first conductive element being configured to be connected to both ends of the first line of the first conductive element, respectively, and to extend in directions different from the direction of the first line of the first conductive element, the first line of the second conductive element being configured to extend from the second position, the second lines of the second conductive element being configured to be connected to both ends of the first line of the second conductive element, respectively, and to extend in directions different from the direction of the first line of the second conductive element.

9. The antenna apparatus as claimed in claim 8, wherein the first conductive element and the second conductive element further include third lines connected to fore ends of the second lines, respectively.

10. The antenna apparatus as claimed in claim 8, wherein the second lines are formed in tapered shapes that spread form connecting portions between the first line and the second line in plan view.

11. The antenna apparatus as claimed in claim 1, wherein the conductive line has a meander shape between the feeding point and the second end of the conductive line in elan view.

12. The antenna apparatus as claimed in 11, wherein the meander shape is rounded meander shape.

* * * * *